United States Patent [19]

Huang et al.

[11] 4,185,161

[45] Jan. 22, 1980

[54] MODULAR GUYLINE INSULATOR

[75] Inventors: Kwang T. Huang, Ventura; Brian R. Milner, Camarillo, both of Calif.

[73] Assignee: The United States of America as represented by the Secretary of the Navy, Washington, D.C.

[21] Appl. No.: 826,608

[22] Filed: Aug. 22, 1977

[51] Int. Cl.[2] ..... H01B 17/02; H01B 17/36; H01B 17/44

[52] U.S. Cl. ..... 174/11 R; 174/30; 174/140 S; 174/179

[58] Field of Search ..... 174/11 R, 11 BH, 30, 174/138 A, 140 S, 176, 177, 178, 179, 186, 192, 198, 199, 207, 208, 12 R, 12 BH

[56] References Cited

U.S. PATENT DOCUMENTS

| | | | |
|---|---|---|---|
| 3,159,709 | 12/1964 | Austin et al. | 174/140 S X |
| 3,325,584 | 6/1967 | Herzig | 174/179 X |

FOREIGN PATENT DOCUMENTS

| | | | |
|---|---|---|---|
| 620243 | 5/1961 | Canada | 174/177 |
| 1063668 | 8/1959 | Fed. Rep. of Germany | 174/179 |
| 1186922 | 2/1965 | Fed. Rep. of Germany | 174/179 |
| 517056 | 12/1920 | France | 174/30 |
| 1357749 | 3/1964 | France | 174/179 |
| 249506 | 10/1926 | United Kingdom | 174/31 R |
| 828958 | 2/1960 | United Kingdom | 174/179 |

OTHER PUBLICATIONS

*Lapp Insulators for* 1928, *Catalog No.* 4, published Mar. 1928 by Lapp Insulator Co., Inc. of LeRoy, New York, p. 72.

Moore, John W., "PRD-49 A New Organic High Modulus Reinforcing Fiber", published by E.I. DuPont de Nemours and Co., Inc., Textile Fibers Department, Wilmington, Del., 18 pages.

*Primary Examiner*—Laramie E. Askin

*Attorney, Agent, or Firm*—Richard S. Sciascia; J. M. St. Amand

[57] ABSTRACT

A modular lightweight, high voltage guyline insulator for VLF antennas. A glass fiber or "Kevlar" rod tension member that provides high tensile strength is enclosed by a porcelain jacket, which serves as a good high voltage insulator, preventing an arc breakdown along the surface and protecting the tension member from exposure to ultraviolet radiation which could cause the tension member to deteriorate. A rubber sleeve extends between each end of the porcelain jacket and a guyline fastening means, and together with the porcelain jacket forms a cavity or chamber around the tension member which is filled with $SF_6$ gas, pressurized to 2 to 4 atmospheres (29.4 psia to 58.8 psia). Metal strips and metal toroid corona rings act to diffuse the electric field.

12 Claims, 2 Drawing Figures

MODULAR GUYLINE INSULATOR

BACKGROUND OF THE INVENTION

This invention relates to guyline insulators and particularly to guyline insulators for VLF antennas.

Guyline insulators currently in use in VLF antennas are made from ceramic-type materials, good insulators but very rigid. Their rigidity makes these insulators highly susceptible to brittle failures, and, therefore, to provide the required physical strength, these insulators are made physically large and very heavy. The result is that they each weigh on the order of several thousand pounds. This tremendous bulk and weight are the major disadvantages of present guyline insulators, which makes the handling, installation and maintenance very difficult and costly.

These insulators are also susceptible to breakdown caused by excessive high voltages which results from lightning or other electrical disturbances. To provide the necessary electrical insulation for high voltage protection, several of these prior type insulators must be connected in series. This, however, only compounds the major disadvantage of the guyline insulator. The tremendous added weight must be supported by the antenna and its guylines, which requires added cost for a stronger antenna structure. Also the added mechanical stresses lead to the increased probability of physical breakdown in both the antenna and guyline insulators.

Various attempts have been made to overcome these problems, but have not resulted in a satisfactory VLF guyline insulator. A variety of techniques have been used, each of which has been lacking in several critical areas.

In an effort to alleviate the prior art problems, the modular guyline insulator of the present invention has been developed. The present invention utilizes lightweight, high tensile strength materials to provide the physical strength at a fraction of the size and weight of prior type ceramic insulators. The present device also provides high voltage protection by the use of toroidal corona rings which force high voltage arcs to occur through the atmosphere rather than through the insulator. As an added feature, the modular guyline insulator provides an indication of possible failure of the insulator before failure occurs. This is a very desirable feature not only from the standpoint of maintenance, but from the resulting increased reliability of the system. Guylines are used on many antennas for structural support. To prevent the grounding of the antennas, guyline insulators are used. These guyline insulators must have high tensile strength and still provide good insulation at high voltages. The modular guyline insulator of the invention meets all of these requirements.

DESCRIPTION OF THE PREFERRED EMBODIMENTS

Figure 1:
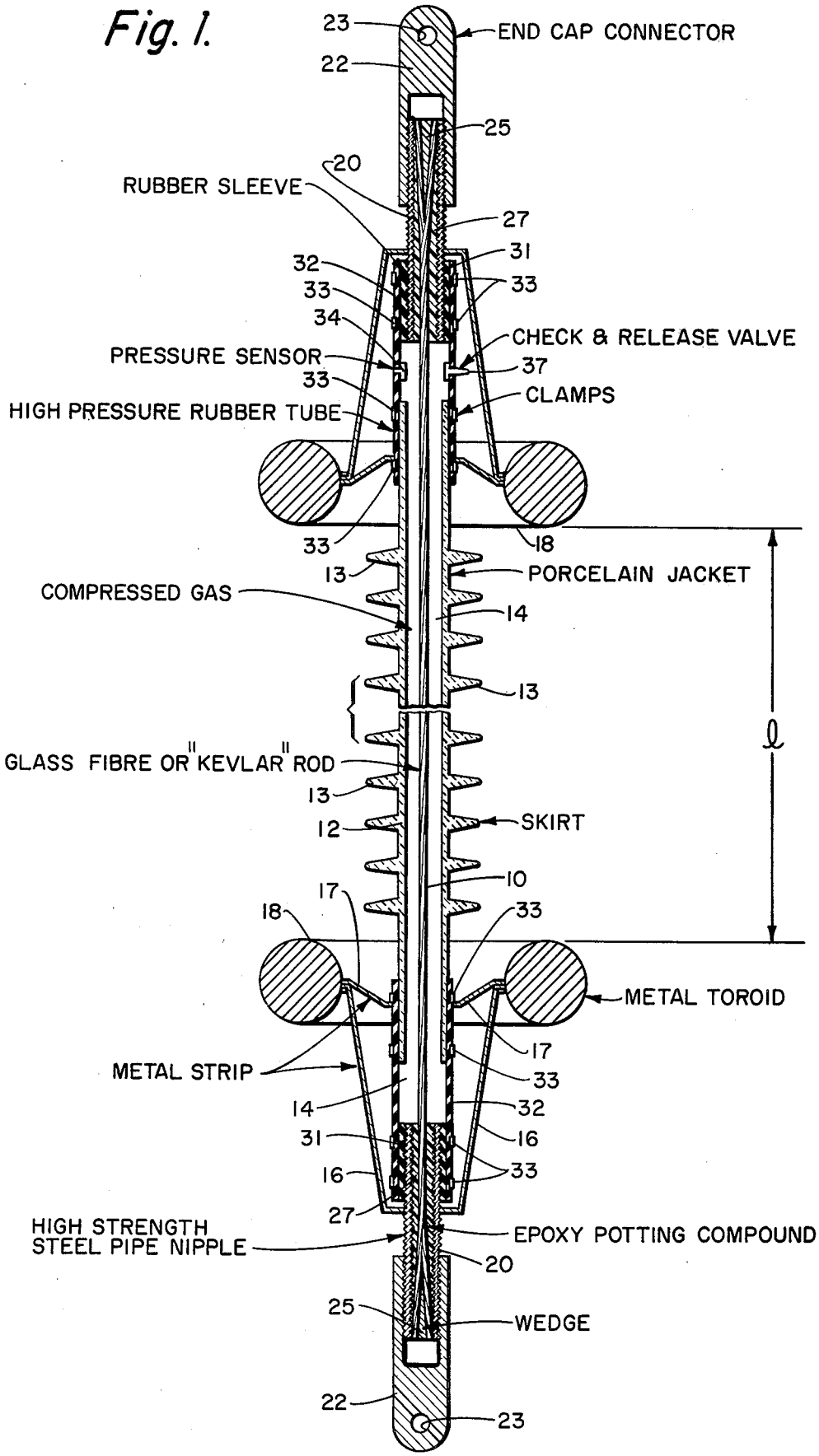
FIG. 1 is a longitudinal cross-sectional view of a preferred embodiment of the invention.

Referring to FIG. 1 of the drawings, a glass fiber or "Kevlar" rod tension member 10 is used in the modular guyline insulator to provide high tensile strength. Tension member 10 is made of fiber class type S, whose strength is comparable to that of steel; however, it is much lighter in weight than steel and is a good insulator. "Kevlar" is made from a polycondensate of m-phenylenediamine and terephthalic acid.

Tension member 10 is enclosed by a shorter outer porcelain jacket 12, which is provided with a plurality of skirts 13, as desired. Jacket 12 serves two purposes: First, it is a good high voltage insulator, which prevents an arc breakdown along the surface of the device; and second, it protects tension member 10 from exposure to ultraviolet radiation which can cause deterioration of the tension member.

The cavity 14 around the tension member is filled with $SF_6$ gas, pressurized to 2 to 4 atmospheres (29.4 psia to 58.8 psia). Pressurized $SF_6$ gas has a high breakdown voltage and also acts to prevent deterioration of tension member 10 due to arcing, thereby prolonging the operational life time of the tension member.

Figure 2:
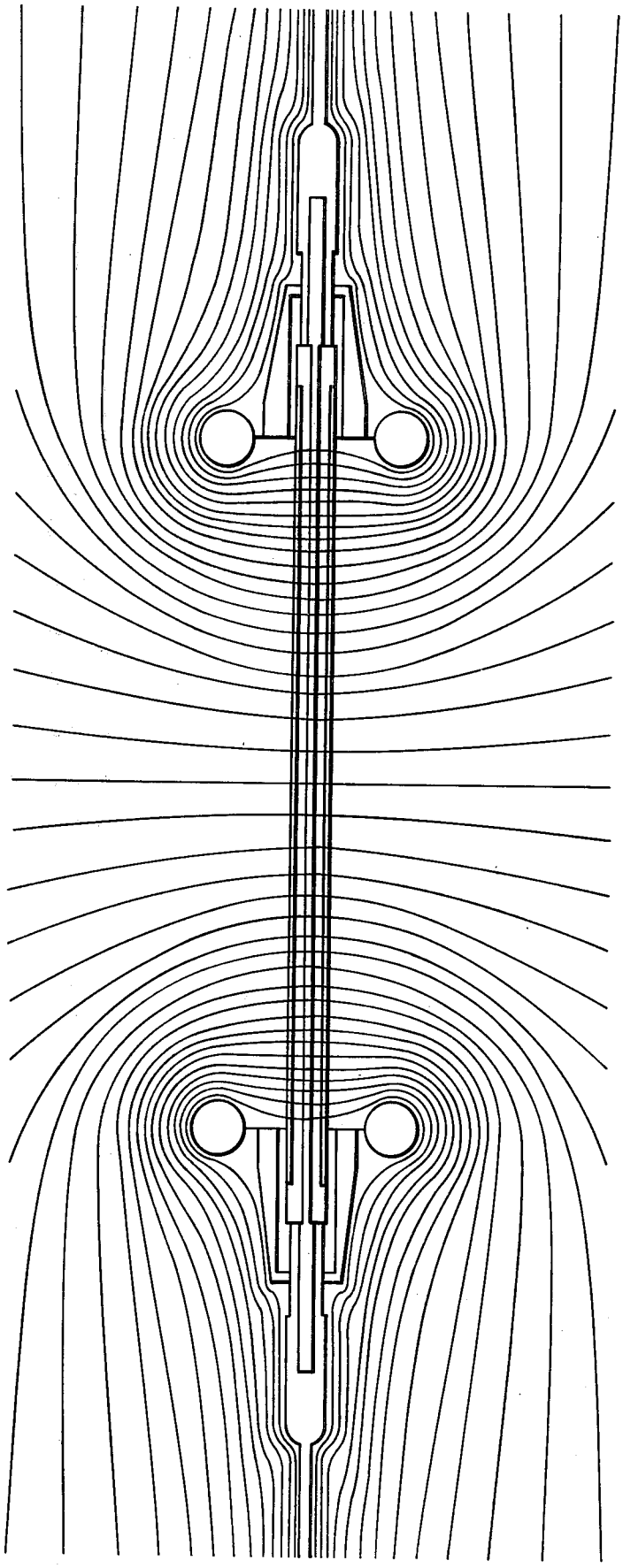
FIG. 2 shows the electric potential distribution for a modular guyline insulator of the type shown in FIG. 1.

Metal strips 16 and 17 and metal toroid corona rings 18 act to diffuse the electric field, as can be seen from the illustration of FIG. 2. Strips 16 and 17 and rings 18 minimize the electric field near the end of the steel pipe nipples 20, and also minimize the possibility of mechanical failure that results from mechanical stresses in a high electric field since elongated metal strips 16 also allow some flexibility. Toroids 18, in addition, provide protection from high voltages by forcing any arcing to occur through the atmosphere outside the insulator rather than through the interior cavity 14, thus preventing any breakdown of tension member 10.

The high strength steel pipe nipples 20 provide a strong connection between the guyline connections at end caps 22 and tension member 10. Porcelain jacket 12, which is shorter than tension member 10, is longitudinally spaced from the nipples 20 at each end where tension member 10 is securely fastened for connection to end caps 22. The guylines, not shown, can be connected through apertures 23 in end caps 22. Additional reinforcement against strain failure is provided by the fastening construction using wedges 25 and epoxy potting compound 27 at both ends of tension member 10.

Rubber sleeve 31 and rubber tube 32 provide a degree of flexibility to the device and help to minimize mechanical stresses on porcelain jacket 12. Each end of chamber 14, between the ends of porcelain jacket 12 and the rubber sleeves 31 which are positioned about the ends of pipe nipples 20, is enclosed merely by a portion of high pressure rubber tube 32, as shown in FIG. 1. High pressure tubes 32 form resilient chamber walls between the ends of jacket 12 and nipples 20 at the ends of chamber 14. As can readily be seen, the rubber tubes allow some limited flexibility in all directions. The wall of chamber 14 formed by rubber tubes 32 obviously can bulge slightly in or out as the gas in chamber 14 expands or contracts with changes in temperature, as well as bend to allow some flexibility and minimize the possibility of mechanical failure due to stresses on the porcelain jacket 12. Clamps 33 hold sleeve 31 and tube 32 tightly in place and seal the gas within chamber 14.

As can be seen from FIG. 1, the metal toroid rings 18 are located at the ends of porcelain jacket 12 and are fastened there by metal strips 17 at the ends of the rubber tubes 32 where they are connected to the procelain jacket. The elongated metal strips 16, which also support toroid rings 18, extend from the toroid rings along the entire length of the rubber tubes 32 to where they are fastened to steel nipples 20 near the end caps 22. Elongated metal strips 16 because of their length permit some degree of flexibility and together with flexible rubber tube sections 32 allow for some movement of both the porcelain jacket 12 and the toroid rings 18 connected thereto under the various weather and climatic conditions, etc., normally experienced by guyline insulators, while minimizing mechanical failure. The metal strips 16 and 17 together with resilient tubes 32 cooperate to position porcelain jacket 12 about tension member 10 while allowing greater flexibility of the modular guyline insulator.

The particular construction, as shown in the drawings, provide greater flexibility through resilient tubes 32 and elongated toroid support strips 16 of the modular guyline insulator thereby minimizing mechanical stresses on the porcelain jacket 12 and maintaining protection of tension member 10.

A pressure sensor 34 on rubber tube 32 plays an important role in the operation and maintenance of the modular guyline insulator. Pressure sensor 34 will give advanced warning of possible electrical and mechanical failure of the insulator. Possible electrical failure could result if a crack occurred in the porcelain jacket, the first step in the breakdown of the insulator. This would cause a leak and sensor 34 would give a low pressure indication. Elongation of the guyline insulator would occur prior to mechanical failure; again a low pressure indication would be given by sensor 34 due to increase in chamber length or a crack in jacket 12. The pressure sensor simplifies maintenance by providing an indication of possible failure before such a failure occurs. A valve 37 is provided for releasing or providing gas to the desired pressure in chamber 14.

The modular guyline insulator provides a lightweight high tensile strength insulator device at only a fraction of the weight and size of prior types of ceramic-type guyline insulators, resulting in tremendous savings in handling, installation and maintenance. The smaller size and weight of the instant insulator provides the capability for using guyline insulators in parallel, giving increased tensile strength and reliability.

Due to its simple construction, the present device is easily assembled and disassembled and defective parts can easily be replaced instead of replacing the entire unit.

In the design of the modular guyline insulator, the separation distance l, shown in FIG. 1, can be modified for operation at different voltages. Thus the device has a wide range of application.

High voltage protection is provided by the toroidal corona rings 18, resulting in arcing through the atmosphere around the insulator, before arcing in the insulation jacket 12 or tension member 10. This will prolong the operational life of the guyline insulator. A warning of possible mechanical or electrical failure is provided by the pressurized $SF_6$ gas and pressure sensor, and allows preventive maintenance to be done during periods of non-crucial operation of the facilities, before actual failure could occur.

Obviously, many modifications and variations of the present invention are possible in light of the above teachings. It is therefore to be understood that within the scope of the appended claims the invention may be practiced otherwise than as specifically described.

What is claimed is:

1. A modular guyline insulator device for use with VLF antennas, comprising:

(a) a single elongated tension member of high tensile strength, lightweight, electrically insulative material;

(b) the ends of said elongated tension member each being securely attached by fastening means to respective guyline connector means;

(c) an elongated cylindrical insulator jacket surrounding and spaced apart from said elongated tension member over at least a major portion of the length of said tension member and forming a cylindrical cavity between said tension member and the inner wall of the cylindrical insulator jacket; said cylindrical insulator jacket being shorter than said tension member and being longitudinally spaced along the length from each of said fastening means; said cylindrical insulator jacket operating to prevent arc breakdown along the surface of the device and protect said tension member from exposure to ultraviolet radiation;

(d) flexible insulative tubular sealing means positioned between each of the ends of said cylindrical insulator jacket and said fastening means to the respective guyline connector means; each of said flexible tubular sealing means forming an extension to said cylindrical cavity between the ends of said cylindrical insulator jacket and said fastening means and operating to maintain the position of said cylindrical insulator jacket about said elongated tension member and seal said cylindrical cavity from the atmosphere;

(e) said cylindrical cavity being filled and pressurized with a high breakdown voltage type of insulative gas which operates to prevent deterioration of said tension member due to arcing;

(f) a pair of metal toroid corona rings and respective first and second metal mounting means therefor; one of said pair of metal toroid rings being mounted at each end of said cylindrical insulator jacket; said first metal mounting means being connected between respective metal toroid rings and the respective ends of said cylindrical insulator jacket; said second metal mounting means being elongated to permit flexibility thereof and being connected between respective metal toroid rings and said fastening means at respective ends of the modular guyline insulator device; said second metal mounting means extending from respective toroid rings at the end of the cylindrical insulator jacket beyond the length of said flexible tubular sealing means to respective said fastening means; said flexible tubular sealing means together with said first and second metal mounting means cooperating to position said cylindrical insulator jacket and simultaneously allow movement of both said metal toroid rings and said cylindrical insulator jacket while minimizing mechanical stresses on said cylindrical insulator jacket for protection of said tension member under various conditions normally encountered by guyline insulators thereby permitting greater flexibility of the guyline insulator device; said guyline insulator device operating to diffuse and minimize the electric field in the vicinity of the said tension member fastening means to respective guyline connector means and simultaneously providing high voltage protection by forcing any arcing to occur through the atmosphere outside the insulator.

2. A modular guyline insulator device as in claim 1 wherein a pressure indicator is provided thereon to detect any leakage of the insulative gas thus giving advanced warning of possible electrical and mechanical failure of the insulator.

3. A modular guyline insulator device as in claim 1 wherein said insulative gas is $SF_6$.

4. A modular guyline insulator device as in claim 1 wherein said flexible tubular sealing means is comprised of rubber and suitable clamping means.

5. A modular guyline insulator device as in claim 1 wherein said tension member is comprised of synthetic fibers, class type S, whose strength is comparable to that of steel and much lighter in weight than steel.

6. A modular guyline insulator device as in claim 1 wherein said insulator jacket is comprised of inorganic materials.

7. A modular guyline insulator device as in claim 1 wherein said cylindrical cavity around said tension member filled with insulative gas is pressurized in the range of approximately 29.4 psia to 58.8 psia.

8. A modular guyline insulator device as in claim 1 wherein said fastening means for securely attaching the ends of said tension member to respective guyline connector means comprise high strength steel pipe nipples with the ends of said tension member secured within respective pipe nipples by a wedge construction means and potting compound, and said guyline connector means attached to an outer end of a respective pipe nipple.

9. A modular guyline insulator device as in claim 1 wherein means is provided for providing or releasing gas to said cylindrical cavity.

10. A modular guyline insulator device as in claim 1 wherein said insulative jacket comprises porcelain.

11. A modular guyline insulator device as in claim 1 wherein said tension member comprises a fiberglass rod.

12. A modular insulator device as in claim 1 wherein said insulative jacket is formed with a plurality of skirts along the length of the exterior wall thereof.

* * * * *